US006708706B1

(12) United States Patent
Robinson

(10) Patent No.: US 6,708,706 B1
(45) Date of Patent: Mar. 23, 2004

(54) RETRACTABLE POOL SHADE WITH SUPPORT STAND

(76) Inventor: Brenda Robinson, 40148 Tesoro La., Palmdale, CA (US) 93551

( * ) Notice: Subject to any disclaimer, the term of this patent is extended or adjusted under 35 U.S.C. 154(b) by 56 days.

(21) Appl. No.: 10/215,824

(22) Filed: Aug. 9, 2002

(51) Int. Cl.[7] ..... E04H 15/58; E04H 4/00

(52) U.S. Cl. ..... 135/117; 135/912; 4/498

(58) Field of Search ..... 135/87, 90, 96, 135/121, 156, 117, 903, 115, 907, 908, 912; 4/494, 496, 498; 52/63, 222

(56) References Cited

U.S. PATENT DOCUMENTS 2,859,756 A * 11/1958 Barnes ..... 135/88.07
2,886,047 A * 5/1959 Healy ..... 135/95
3,009,166 A * 11/1961 Sears ..... 4/494
3,854,149 A * 12/1974 Mischke ..... 4/494
5,437,298 A * 8/1995 Lin ..... 135/117
5,579,796 A * 12/1996 Mallo et al. ..... 135/88.06

FOREIGN PATENT DOCUMENTS

GB 2058167 * 4/1981

* cited by examiner

*Primary Examiner*—James O. Hansen
(74) *Attorney, Agent, or Firm*—Goldstein Law Offices, P.C.

(57) ABSTRACT

A retractable pool shade, for use with a pool having a pool edge and a pool deck extending outside of the pool edge, having a shading assembly and a stand. The stand has a pair of horizontal members which extend parallel to each other and are supported by legs. The shading assembly includes a shading element which is selectively deployable along the horizontal members. Wheels are provided at the bottom of the legs to selectively provide mobility to the pool shade around the pool deck. Suction cups are associated with the legs to selectively engage the pool deck to maintain the stand in a stationary position.

6 Claims, 4 Drawing Sheets

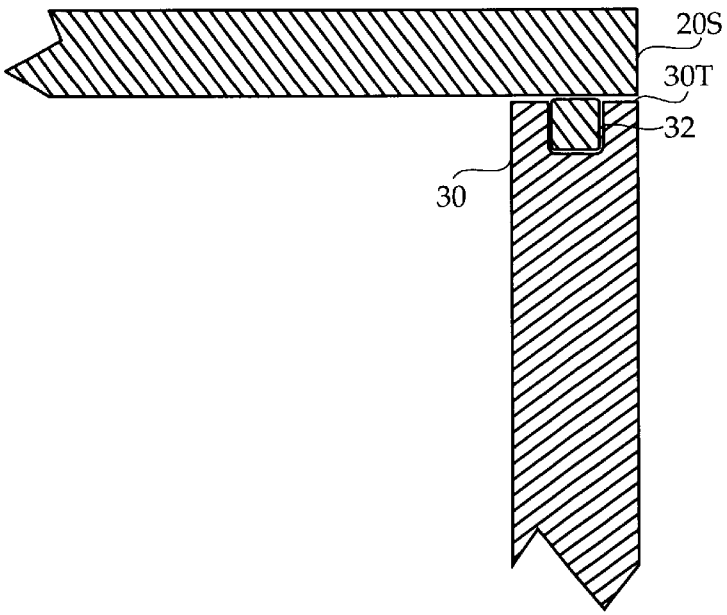
Fig. 2
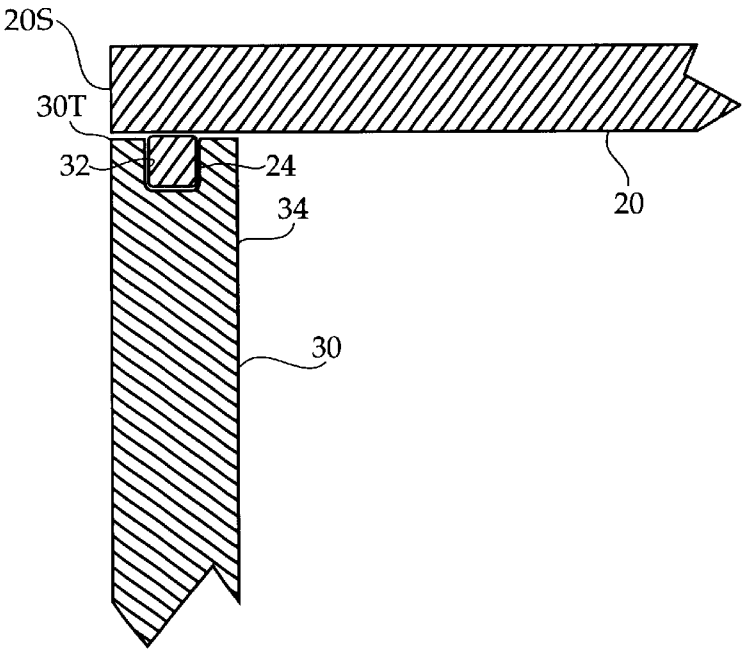

RETRACTABLE POOL SHADE WITH SUPPORT STAND

BACKGROUND OF THE INVENTION

The invention relates to retractable pool shade which is attached to a support stand having legs which each have wheels so that the shade can be easily moved to various locations surrounding the pool. The wheels can be retracted thereby allowing suction cups above each wheel to engage the deck of the pool, causing the pool shading assembly to be immobilized.

SUMMARY OF THE INVENTION

It is an object of the invention to produce a shade which can be used to protect people who are swimming in a pool from the direct rays of the sun. Accordingly, the shade extends directly over and across a pool to selectively block the sun from reaching the pool.

It is a further object of this invention to provide a shade which may be easily moved to various locations above and surrounding the pool. The repositioning of the shade will allow the pool to be continuously shaded from the sun, in spite of the differing position of the sun at various times of the day. Accordingly, the shade is supported by a frame having wheels which are selectively deployable to the ground to allow the shade to be moved so as to extend over different areas of the pool.

It is a further object of this invention to provide a shade assembly which, once it has been wheeled to a desired location, may be easily immobilized to remain at that location. Accordingly, by the retraction of the wheels, suction cups located above each wheel are able to contact and attach to a surface.

It is a further object of this invention to provide the owner with a product which allows easy interchangeability of the shading element with other designs and shapes, so that its use may be tailored to different occasions. Accordingly, the shading element can be made of fabric which is easily interchanged with other fabric shading elements-while using the same frame structure.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 2 is a cross-sectional view taken along line 2—2 of FIG. 1, illustrating the tracks on which the shade slides.

DETAILED DESCRIPTION OF THE PREFERRED EMBODIMENTS

Figure 1:
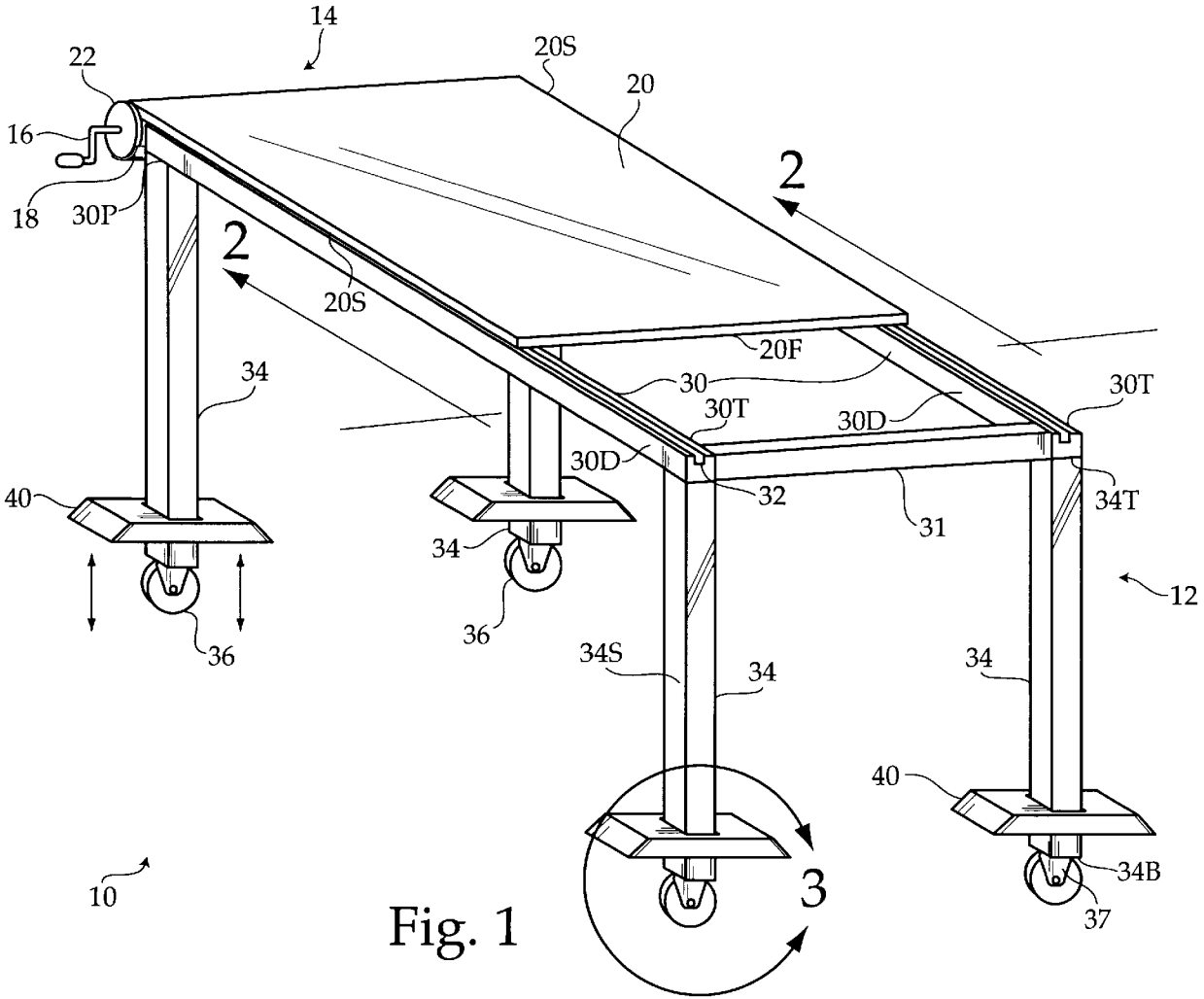
FIG. 1 is a perspective view of the retractable pool shade with support stand.
Figure 4:
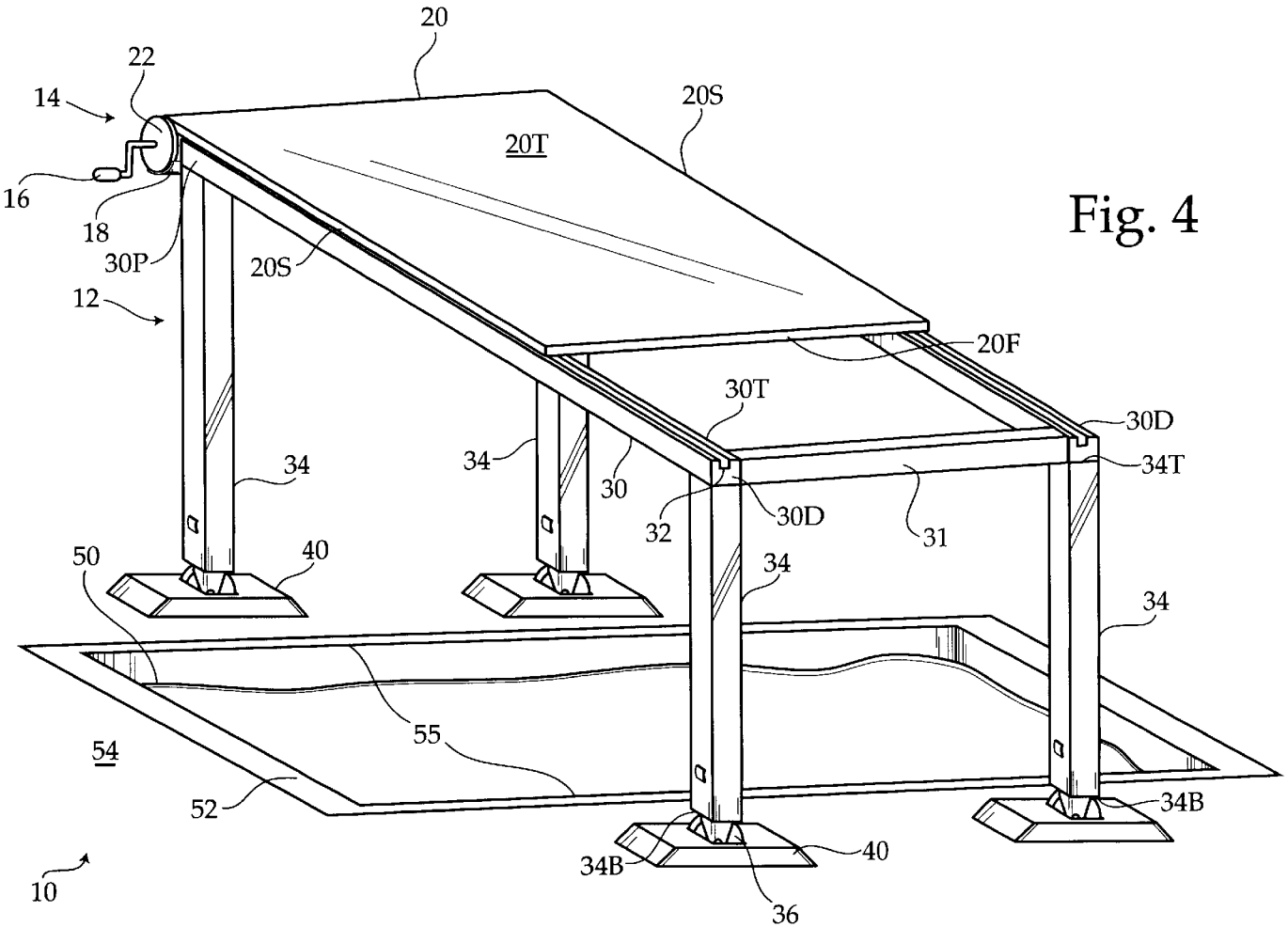
FIG. 4 is a respective view of the retractable pool shade with support stand after it has been immobilized over a swimming pool.

FIG. 1 illustrates a retractable pool shade 10. Referring momentarily to FIG. 4, the pool shade 10 is used in conjunction with a pool 50, defined by a pool edge 52. The pool edge 52 is surrounded by a pool deck 54. The pool edge 52 includes a pair of opposite sides 55.

The pool shade 10 has a stand 12 and a shading assembly 14. The stand 12 includes a pair of horizontal members 30, which extend substantially parallel to each other. Each horizontal member 30 has a top surface 30T having a longitudinal groove 32. The horizontal members 30 have a proximal end 30P and a distal end 30D. The horizontal members 30 are each supported by a pair of legs 34, wherein one leg is generally located at the proximal end 30P of each horizontal member 30, and another leg is generally located at the distal end 30D of each horizontal member 30D.

The shading assembly 14 includes a shading element 20 and a roller 22 for selectively storing and deploying the shading element 20. Naturally, the shading element 20 is made of a sheet-like flexible material, such as plastic or fabric. The shading element 20 has a forward edge 20F and a pair of sides 20S, which extend parallel to each other. The shading element 20 is sized so that the sides 20S of the shading element 20 correspond with the horizontal members 30. The roller 22 is located near the proximal end of the horizontal member 30. Accordingly, in deploying the shading element 20, the forward edge 20F of said shading element 20 is moved along the tops 30T of the horizontal members 30 from the roller 22 at the proximal end 30P of the horizontal members 30 toward the distal end 30D of the horizontal members 30.

Referring to FIG. 2, to facilitate smooth movement of the shading element 20 along the tops 30T of the horizontal members 30, the shading element 20 has a pair of runners 24, each runner extending near and parallel to one of the sides 20S of the shading element 20. Referring to FIG. 2, each runner 24 is slidably mounted within one of the grooves 32. Accordingly, the runners 24 guide the shading element as it is deployed, preventing lateral movement of the shading element 20. Preferably, the groove is closed at both the proximal and distal end of the horizontal member to prevent the shade from extending past either of said ends.

It should be noted that the horizontal members 30 need not extend perfectly straight in the vertical plane. Accordingly, "horizontal" should be interpreted herein as "generally" horizontal, but not necessarily strictly horizontal. In particular, both horizontal members 30 may be arched upward in an identical fashion. Provided that the runners 24 are configured to engage the longitudinal grooves 32 in a suitable fashion to allow the runners to follow a possibly arched longitudinal groove 32 while remaining within said longitudinal groove 32, the shading element can indeed follow such an arched configuration. Accordingly, the configuration shown in FIG. 2 may be modified, as would be appreciated by one of ordinary skill in the art, to maintain the runner 24 within the groove 32 so as to follow a curved or angular redirection of the groove. In this regard, with such accomodation, the horizontal members may even be peaked at their center.

Referring once again to FIG. 1, a semicircular bracket 18 supports the roller 22 and extends perpendicularly between the horizontal members 30 at the proximal ends 30P thereof. In order to deploy or retract the shade element 20, the roller 22 is rotated by means of an axially mounted crank handle 16. Rotation of the roller causes the shading element 20 to slide to various positions along the horizontal members 30, thereby allowing the position of the shading element 20 to be adjusted even without necessitating the repositioning of the stand 12. In order to maintain the horizontal members 30 parallel to each other, a pair of cross members 31 preferably extend between the horizontal members 30 at the proximal 30P and distal 30D ends thereof and extend perpendicular to the horizontal members 30.

The legs 34 provide a means for supporting the shading assembly 14. The legs 34 have a top portion 34T, a bottom portion 34B, and at least one leg side 34S. Specifically, the top portion of the legs 34T are attached immediately beneath the horizontal members 30.

Wheels 36 are mounted to the bottom portion 34B of each leg 34, thereby allowing the retractable pool shade 10 to be moved to various positions surrounding the pool depending on the position of the sun and the desire of the user. In particular, the wheels 36 are mounted to the leg bottom 34B using a caster frame 37. The wheels 36 may be prevented from contacting the ground when the user desires to immobilize the retractable pool shade at a given position by using an immobilizing block 40.

In particular, the immobilizing of the wheels is accomplished by pressing down on the immobilizing block 40 which is located above each wheel 36. To accomplish the same, referring to FIG. 3, each immobilizing block 40 has a block top 40T, a block bottom 40B, and a bore 41 extending fully between the block top 40T and block bottom 40B. The bore 41 is sized and shaped to closely accommodate the leg 34, such that the leg 34 extends fully through the bore 41 and allows the block to slide vertically upward and downward upon the leg 34.

Figure 3:
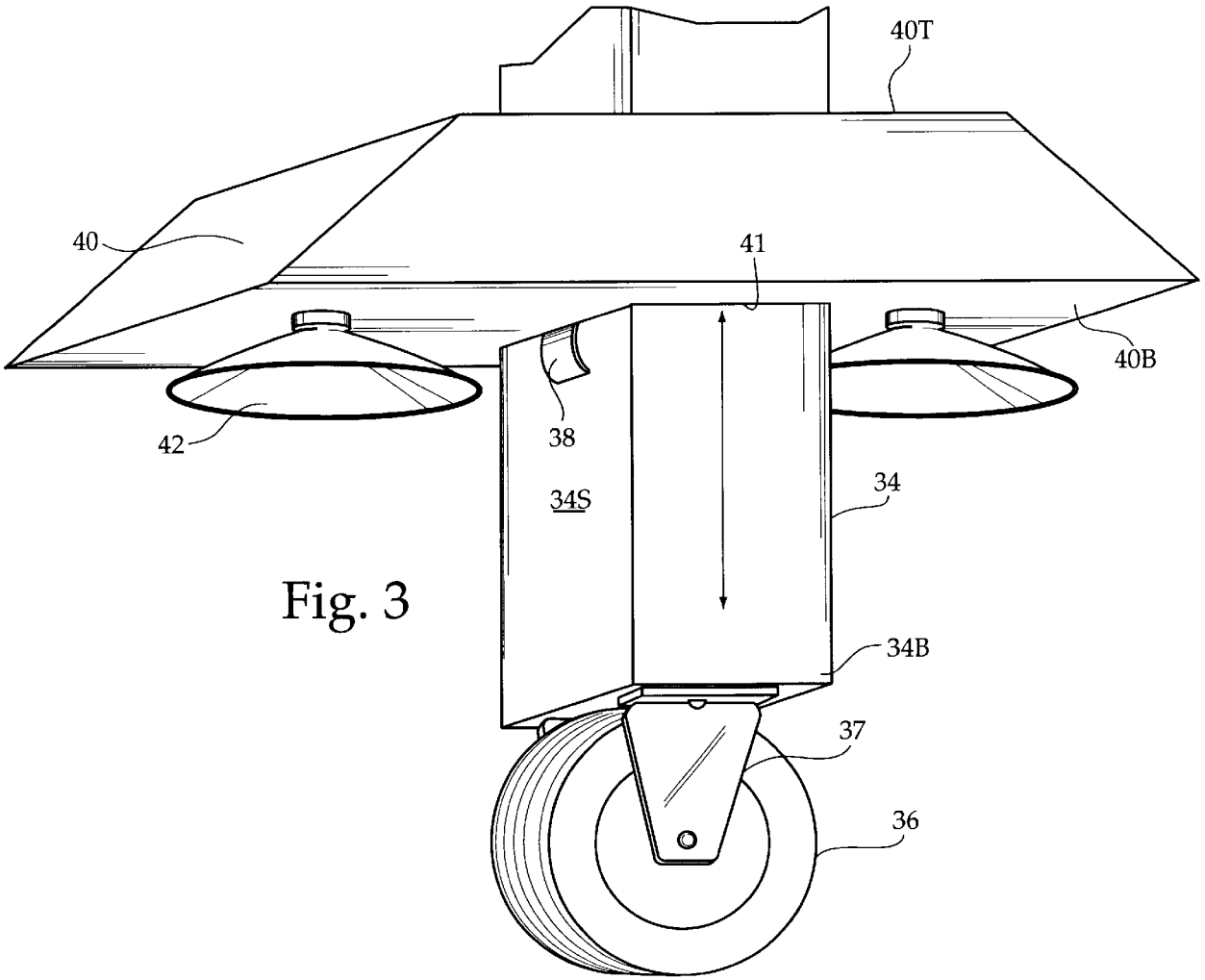
FIG. 3 is an enlarged perspective view taken generally in the area of circle 3 in FIG. 1, illustrating the retractable wheels upon which the entire shade assembly may be supported when the shade is being moved.

As illustrated in FIG. 3, attached to the side 34S of each leg above the the leg bottom 34B is a spring clip 38. This spring clip is capable of supporting the weight of the immobilizing block 40, and thereby maintaining the block 40 well above the leg bottom 34B. When the immobilizing block 40 is positioned above the spring clip 38, as seen in FIGS. 1 and 3, the wheels are not prevented from rolling on the pool deck and the retractable pool shade 10 is easily wheeled to any desired location along the pool deck 54. Accordingly, the shade 10 may be easily repositioned as the position of the sun changes, and the user's need or desire for shade varies.

However, after the retractable pool shade has been rolled to its desired position, the block 40 is lowered to prevent further movement of the retractable pool shade 10 along the deck 54, as seen in FIG. 4. In order to lower the block 40, the block 40 is pressed downward by the user. In this regard, the spring clip 38 which normally supports the weight of the block 40 and keeps it well above the wheel 36 on the side of the leg 34S can be easily overcome by such pressure by the user, so as to allow the block to move below the spring clip toward the bottom of the leg 34B. The block bottom 40B will fall beyond the leg bottom 34B such that the block bottom 40B may come into direct contact with the pool deck 54. By friction alone, the block 40 is capable of preventing the wheels 36 from rolling on the pool deck 54, thus immobilizing the entire retractable pool shade 10.

Additionally, referring once again to FIG. 3, suction cups 42 may be mounted to the block bottom 40B. The suction cups 42 extend and are oriented downward from the block bottom 40B to positively adhere to the pool deck 54 such that the block 40 is more effective at preventing the wheels 36 from rolling and thereby for immobilizing the pool shade 10, as shown in FIG. 4.

In use, after ensuring that the blocks 40 are elevated off the pool deck 54, and preferably positioned above the spring clips 38, the pool shade 10 can be wheeled to a desired location on the pool deck 54 by pushing against the stand 12. Generally, it is positioned so that the pool shade extends across the pool 50, with the legs 34 on opposite sides 55 of the pool 50. Once suitably positioned, the blocks 40 are lowered to the deck 54, engaging the deck with the suction cups 42. Then, the shading element 20 may be deployed across the stand 12 by moving the forward edge 20F of the shading element 20 across the horizontal members 30 toward the distal ends 30D thereof. This is generally accomplished by turning the crank handle 16 to unreel the roller 22 which stores the shading element 20. The user can adjust the position of the forward edge 20F, and thereby the extent by which the shading element 20 extends across the horizontal members 30, and/or move the stand to achieve the desired shading from the shading device 10. When the sun changes position in the sky, or the user's desire for shade is otherwise altered, the shading element 20 can be retracted by turning the crank handle 16 to store the shading element 20 upon the roller 22 and/or the blocks 40 can be raised and disengaged from the deck 54 so that the stand 12 can be repositioned as desired.

In conclusion, herein is presented a pool shade which may be wheeled to any desired location and then immobilized by retracting the wheels and causing the overlying suction cups to contact the pool deck. The invention is illustrated by example in the drawing figures, and throughout the written description. It should be understood that numerous variations are possible, while adhering to the inventive concept. Such variations are contemplated as being a part of the present invention.

What is claimed is:

1. A retractable pool shade with support stand for protecting swimmers in a pool, having a pool edge, and a pool deck surrounding the pool edge, from the direct rays of the sun, comprising:

a stand, having a pair of horizontal members which extend parallel to each other, each horizontal member having a proximal end, a distal end, and a longitudinal groove extending substantially between the proximal and distal ends, the stand further having legs for supporting the horizontal members, the legs each having a leg bottom and a wheel mounted to the leg bottom for allowing the stand to roll around the pool deck to reposition said stand, the stand also having at least one suction cup associated with each leg and movable with respect to that leg bottom, for selectively engaging the deck below the leg bottom to prevent the stand from rolling; and a shading assembly having a shading element made of a sheet-like flexible material, said shading element having a forward edge, a pair of parallel side edges, and a pair of runners which are each located in one of the longitudinal grooves of one of the horizontal members such that the forward edge is capable of being moved along the horizontal frame from the proximal end to the distal end.

2. The retractable pool shade with support stand as recited in claim 1, wherein the stand further comprises an immobilizing block associated with each leg, each immobilizing block having a block top, a block bottom, and a bore extending fully between the block top and block bottom, the bore sized and shaped so as to allow the leg to extend through the block whereas the block is slidably mounted on the leg for close vertical movement of the block thereon, the suction cup associated with that leg attached to the block bottom and oriented downward therefrom to selectively engage the deck when the block is moved sufficiently downward on the leg to prevent the stand from rolling.

3. The retractable pool shade with support stand as recited in claim 2, wherein the shading assembly further comprises a roller, the roller extending between the horizontal members at their proximal ends, the shading element selectively stored and deployable from the roller.

4. The retractable pool shade with support stand as recited in claim 3, wherein the stand further comprises at least one cross member extending between the horizontal members to maintain the parallel relationship of said horizontal members.

5. The retractable pool shade as recited in claim 4, having two cross members, one of the cross members located at the distal end.

6. The retractable pool shade as recited in claim 4, wherein the shading assembly further has a semi-circular bracket for supporting the roller, and an axial crank attached to the roller for selectively deploying and retracting the shading element.

* * * * *